US006367350B1

(12) United States Patent
Kappel et al.

(10) Patent No.: US 6,367,350 B1
(45) Date of Patent: Apr. 9, 2002

(54) METHOD AND APPARATUS FOR STROKE TRANSMISSION

(75) Inventors: Andreas Kappel, Brunnthal; Randolf Mock; Bernhard Gottlieb, both of Munich; Hans Meixner, Haar, all of (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/446,405

(22) Filed: Dec. 20, 1999

(30) Foreign Application Priority Data

Dec. 18, 1998 (DE) ..... 198 58 758

(51) Int. Cl.[7] ..... G05G 1/04

(52) U.S. Cl. ..... 74/516; 74/518; 251/129.06; 310/328

(58) Field of Search ..... 74/110, 516, 518, 74/519, 522; 251/129.06; 310/328

(56) References Cited

U.S. PATENT DOCUMENTS

| | | | | | |
|---|---|---|---|---|---|
| 2,649,815 | A | * | 8/1953 | Kaye | 74/516 |
| 3,045,500 | A | * | 7/1962 | Bruun | 74/516 |
| 4,339,961 | A | * | 7/1982 | Grillot et al. | 74/110 |
| 4,347,754 | A | * | 9/1982 | Wehler | 74/110 |
| 4,609,178 | A | * | 9/1986 | Baumann | 74/110 |
| 4,617,969 | A | * | 10/1986 | Weiger et al. | 251/129.06 |
| 4,715,245 | A | * | 12/1987 | Daloz | 74/522 |
| 4,791,824 | A | * | 12/1988 | Adam-Nicolau | 74/110 |
| 4,927,084 | A | * | 5/1990 | Brandner et al. | 251/129.06 |
| 5,117,213 | A | * | 5/1992 | Kreuter et al. | 335/219 |
| 5,181,430 | A | * | 1/1993 | Panin | 74/110 |
| 5,251,502 | A | * | 10/1993 | Eisbrenner et al. | 74/110 |
| 5,253,671 | A | * | 10/1993 | Kolenc | 74/110 |
| 5,516,075 | A | * | 5/1996 | Itoi et al. | 74/110 |
| 5,946,969 | A | * | 9/1999 | Munekata et al. | 74/110 |
| 5,996,432 | A | * | 12/1999 | Orbea et al. | 74/518 |
| 6,142,444 | A | * | 11/2000 | Kluge | 251/129.06 |

FOREIGN PATENT DOCUMENTS

| | | |
|---|---|---|
| DE | 41 29 832 | 3/1993 |
| DE | 43 06 072 | 12/1994 |
| DE | 197 10 601 | 9/1998 |
| DE | 195 19 191 | 12/1998 |

OTHER PUBLICATIONS

Oppelt, Kleines Handbuch Der Regelvorgange, Verlag Chemie GmbH Weinheim/bergstr. 1964, pp. 257–261.

* cited by examiner

*Primary Examiner*—David A. Bucci
*Assistant Examiner*—Chong H. Kim
(74) *Attorney, Agent, or Firm*—BakerBotts LLP

(57) ABSTRACT

A stroke transmission apparatus includes a displaceable stroke element, a drive element and at least one lever, which is respectively seated on the drive element and can be applied to the stroke element and to a bearing, so that with a simultaneous seating of the lever on the stroke element, on the drive element and on the bearing, a primary stroke (xp) can be transmitted to the stroke element via a lever effect of the lever, and with a changing primary stroke (xp), a stroke factor (II) can be modified by modifying at least one contact point.

18 Claims, 6 Drawing Sheets

METHOD AND APPARATUS FOR STROKE TRANSMISSION

BACKGROUND OF THE INVENTION

The invention relates to an apparatus and a method for stroke transmission between a drive element and a stroke or reciprocating element.

A stroke transmission is often used in areas where it may be advantageous to separate a drive system into a separate drive element and stroke element. For example, this may be done to simplify a manufacturing process, to permit use of different materials in different parts of the drive system, or to simply provide a change of stroke or ratio.

In the stroke transmission, a particular ratio is set between the secondary stroke (xs) of the stroke element and the primary stroke (xp) of the drive element, expressed by the stroke factor (II), where II=xs/xp.

A stroke gear reduction, corresponding to a stroke factor II<1, is realized for example in systems in which a comparatively large-stroke motor is supposed to drive a stroke element having a small travel.

A neutral stroke transmission, corresponding to a stroke factor II=1, is for example desirable if the stroke of an actuator is supposed to be communicated precisely via a stroke element that is realized differently in terms of materials.

A stroke gearing up or multiplication occurs when there is a stroke factor II>1, for example given small-stroke actuators whose stroke is supposed to be enlarged via a stroke element for the necessary application.

For stroke transmission, in particular for stroke gearing up, German patent documents DE 195 19 191 A1 and DE 43 06 072 C2 disclose the use of a hydraulic chamber between the drive element and the stroke element is known, whereby the ratio of the surface of the pressure-exposed drive element to the surface of the pressure-exposed stroke element directly determines the stroke factor.

A problem in stroke transmission is that a combination of different types of stroke transmission is often required. A neutral stroke transmission is often needed at the beginning of an actuation process with a subsequent stroke gearing up, e.g., given a stroke transmission from a piezoelectric actuator to an injector needle or vale needle for the operation of a servo-valve-controlled fuel injector.

In this context, a large force has to be applied for the initial precise opening of a servo-valve chamber. Immediately after this application of force, the pressure in the valve chamber falls to a low value, so that a significantly smaller force is sufficient of the further opening. For the reproducibility of the opening behavior within narrow tolerances (injection quantity, beginning of injection), a wide opening of the valve chamber is required. Due to the small useful stroke of the piezoactuator, a stroke gearing up is necessary for this purpose.

SUMMARY OF THE INVENTION

A stroke transmission apparatus and a stroke transmission method are not known wherein a stroke factor II is dependent on a primary stroke xp of a drive element.

One object of the present invention is to provide a stroke transmission capable of providing a variable stroke factor II. Another object of the present invention is to provide a stroke transmission method capable of providing a variable stroke factor II.

These and other objects, features and advantages of the present invention are achieved by a stroke transmission apparatus and a method of transmitting stroke.

For this purpose, a displaceable drive element, a stroke element that can be displaced in the same direction, and at least one lever are used.

Unless otherwise indicated, for better understanding "a lever" is to be understood as referring to at least one lever, while the singular is expressed by "exactly one lever."

The lever is applied continuously to the drive element, and can be placed on or in contact with the stroke element and a bearing. The primary stroke xp in which the lever is actually placed on the stroke element and the bearing depends on the respective specific embodiment and on the primary stroke xp.

However, if a simultaneous seating or contact of the lever on the stroke element, the drive element, and the bearing is present, a lever effect results, so that the primary stroke xp of the drive element can be transmitted to the stroke element via the lever action of the lever. The stroke factor II can thereby vary between a gearing up transmission (<1), a neutral transmission (=1) or a gear reduction transmission (>1).

When the lever effect is present, a primary drive force is transmitted from the drive element to the lever via a force introduction point, and from the lever it is transmitted to the stroke element via a stroke point. The lever is supported on the bearing at a pivot point. The region on the one side of the lever between pivot point and force introduction point thus corresponds to a power arm of length L1, and the region between the stroke point and pivot point corresponds to a work arm of length L1+L2, which is also designated the effective lever length.

In addition, the stroke transmission is formed in such a way that as the primary stroke xp changes, the stroke factor II can be modified at least once by modifying at least one contact point. A contact point is to be understood as a pivot point, a stroke point or a force introduction point.

Such a mechanical stroke transmission has the advantage that, in contrast to a hydraulic or mechanical-hydraulic stroke transmission, the need for a fluid chamber can be eliminated. In this way one advantageous result is that the secondary stroke xs is largely independent of the duration of actuation.

In addition, another advantageous result is that of a stroke transmission free of delay.

A very flexible geometrical construction of the individual components is also advantageously possible, so that the stroke factor II can be varied within a wide range and dynamically. Thus, dependent on the primary stroke xp, it can be varied continuously or discontinuously. The stroke factor II can for example be set to increase, to be constant, to decrease, or to include any combination of these.

For the simple adjustment of the stroke factor II, it is advantageous if the lever is respectively applied continuously to a pivot point on the bearing. In the initial position, i.e. given a primary stroke xp=0,the stroke element is placed loosely on the drive element, and there is a spacing (h) or gap between the lever and the stroke element.

Given an actuation by means of an increase of the primary stroke xp, the spacing h is reduced until the lever rests at a changeover point xp=xt when h=0 on the stroke element. At this point, a lever effect of the lever can be transmitted to the stroke element. In this case, the modification of a contact point thus corresponds to the seating of the lever on the stroke element.

If the primary stroke xp is even smaller than or is equal to the changeover point (xt), i.e. xp $\leqq$xt, then the stroke factor II=1, dye to the direct mechanical contact between the drive element and the stroke element. In contrast, it is also generally true that the stroke factor II>1 for xp>xt.

For the simple construction, in particular given use in a servo-valve-controlled duel injector, for xp>xt a stroke factor II between 1 (e.g., initial opening of the servovalve with large force) to 10 (e.g. wide subsequent application of force) is preferred.

For simpler adjustment, it can be advantageous in the initial position to place the lever on the stroke element and not on the bearing, so that a spacing results between the lever and the bearing. The manner of action of such a construction is analogous to that with a spacing between the lever and the stroke element. For example, if xp is less than or equal to xt, then the stroke factor II is again equal to 1 because the drive element and stroke element are in direct mechanical contact.

For the variable adjustment of the stroke factor II, it is advantageous if the lever sits permanently on the stroke element and on bearing, so that a mechanical non-positive, or frictional, or a surface to surface connection is present between the drive element and the stroke element during the entire stroke process. This is equivalent to a continuous presence of the lever effect. This is caused by the direct contact between the drive element and the lever as well as the direct contact between the bearing and the lever and the stroke element and the lever.

For this purpose, in the initial position each lever is applied to the drive element via a respective interior force introduction point or the contact point.

In the initial position, when xp=0 a direct mechanical contact can additionally be given between drive element and stroke element.

Given a changing primary stroke xp, the lever can be moved in such a way that the respective force introduction point can be modified. By modifying the force introduction point, the stroke factor II can in turn be modified.

The stroke factor II can thereby change at least from one region to the next within a stroke interval of the primary stroke xp, but is can also remain constant from one region to the next. Region utilized herein, unless more specifically identified, refers generally to the surface areas of the elements near the contact points.

For the rapid modification of the stroke factor II, it is advantageous if the external force introduction points, i.e., all force introduction points other than the one for xp=0, are spatially separated from one another. In this way, a discontinuous modification of the stroke factor II can be achieved, given continuous modification of the primary stroke xp.

for the versatile adjustment of the stroke factor II, it is advantageous if the interior and exterior force introduction points are arranged in continuous fashion at least from one region to the next, i.e., passing over into one another spatially. In this way, it is possible to vary the stroke factor II continuously given continuous modification of the primary stroke xp.

For the purpose, it is advantageous if the lever is applied respectively to a surface of the drive element that is curved at least from one region to the next, so that a continuous modification of the stroke factor II can be set, at least from one region to the next, by means of the primary stroke xp. This can advantageously take place in that the surface is alternately curved in convex and in concave fashion, so that the stroke factor II can be modified continuously between continuous surface variations, and can in addition vary between the values <1, =1 and >1.

In addition, for precise stroke transmission it is advantageous if exactly one lever is present, because by this means an expensive adjustment (e.g. caused by manufacturing tolerances) of the position of several levers can be avoided.

It is advantageous if a primary stroke xp of 10 $\mu$m to 100 $\mu$m can be executed. This is typically the case if the drive element is driven by a piezoactuator or a magnetic or electronic element. Here the use of a ceramic multilayer piezoactuator is particularly preferred.

The use of a stroke gearing-up device is particularly advantageous in a fuel injector, due to the delay-free switching that can be accomplished by the stroke transmission of the invention.

BRIEF DESCRIPTION OF THE DRAWINGS

In the following exemplary embodiments, the stroke transmission is shown in more detail schematically.

DETAILED DESCRIPTION OF THE PREFERRED EMBODIMENTS

Figure 1:
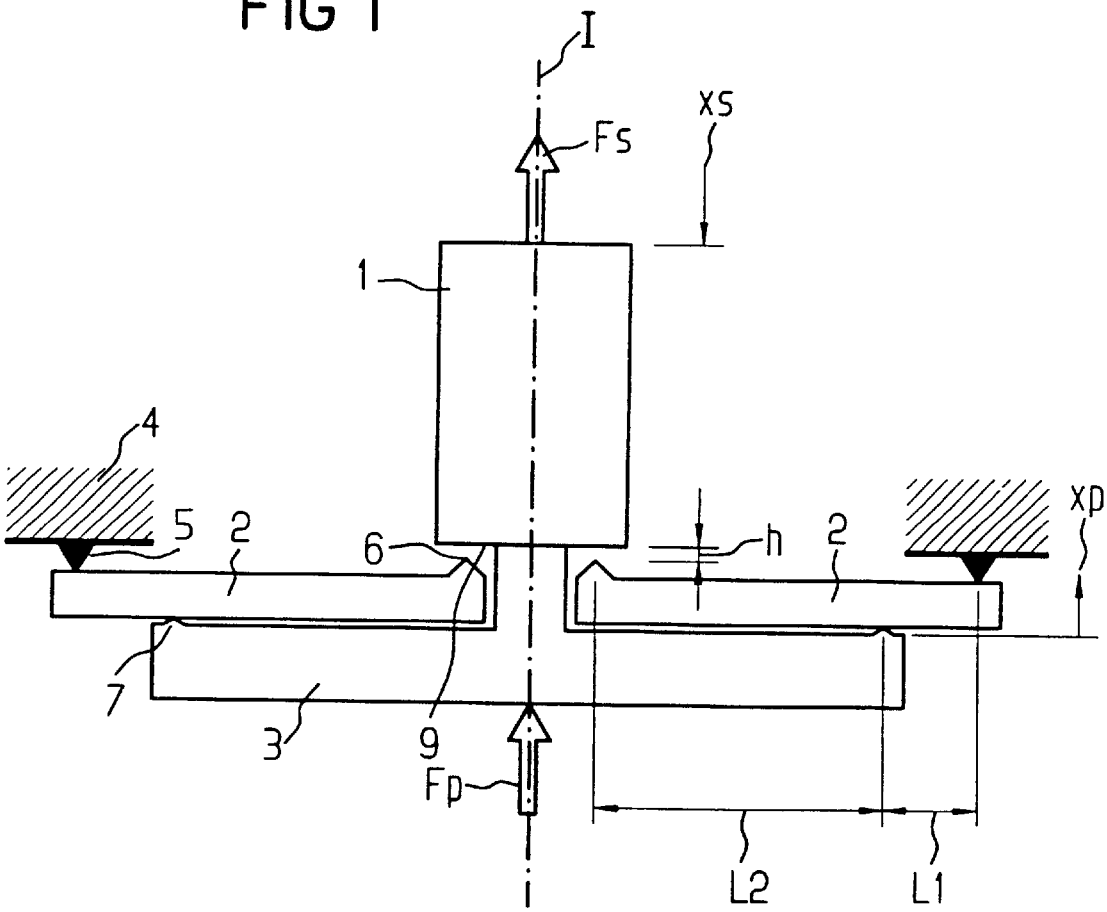
FIG. 1 shows an apparatus for stroke transmission having a variable stroke factor II.

In FIG. 1, an apparatus for stroke transmission is shown (in a sectional side view) in the initial position, in which two different stroke factors II can be used and achieved during a stroke process.

A stroke element 1 sits loosely on a drive element 3. Two levers 2 are shown, each of which is applied to a force introduction point 7 on the drive element 3. Each lever 2 is additionally applied to a pivot point 5 of a bearing 4. The levers 2 can in addition be placed having a stroke point 6 on the stroke element 1, in this exemplary embodiment by being placed on a seating surface 9 facing the drive element 3.

The stroke element 1 and the drive element 3 are constructed in such a way that each of them can be formed having a generally symmetrical construction, either with an arbitrary rotation about the axis of rotation (I) (completely rotationally symmetrically) or after a rotation about an angle of 360°/n (n-fold rotationally symmetrically).

For example, n levers ($n \in N_+$) can be distributed in uniform fashion at an angular spacing of 360°/n to one another, the stroke element 1 can be constructed in completely rotationally symmetrical fashion, and the drive element 3 can have webs, at an angular spacing of 360°/n, as force introduction points 7. However, the drive element 3 can also be constructed in completely rotationally symmetrical fashion, so that the force introduction points 7 are located on a ring of the drive element 3 about the axis of rotation I. In this exemplary embodiment, a completely rotationally symmetrical drive element 3 and n=3 equally spaced levers are preferred.

The lateral or radial spacing between stroke point 6 and pivot point 5 is designated as a work arm of length L1+L2, and the lateral or radial spacing between force introduction point 78 and pivot point 5 is designated as a power arm of length L1.

In the initial position, given a primary stroke xp=0 of the drive element 3, this element is pulled back so far that there is a spacing h in the direction of the axis of rotation I between lever 2 and stroke element 1 in the region of the stroke point 6. From xp=0, it follows that the secondary stroke xs=0 as well. In the initial position, no lever effect thus occurs via the levers 2; rather, there exists exclusively a direct non-positive connection via the abutment or surface to surface contact surface of stroke element 1 and drive element 3.

During an actuation process by means of the application of a primary drive force (Fp) along axis of rotation I, the primary stroke xp is raised relative to the bearing 4. The primary drive force Fp is applied via an actuator, e.g. a piezoactuator, whereby the drive element 3 can be a part of the actuator. By means of the motion of the drive element 3, the stroke element 1 is displaced in the same direction by the distance of its secondary stroke xs, whereby a secondary drive force (Fs) can be transmitted further.

Figure 2A:
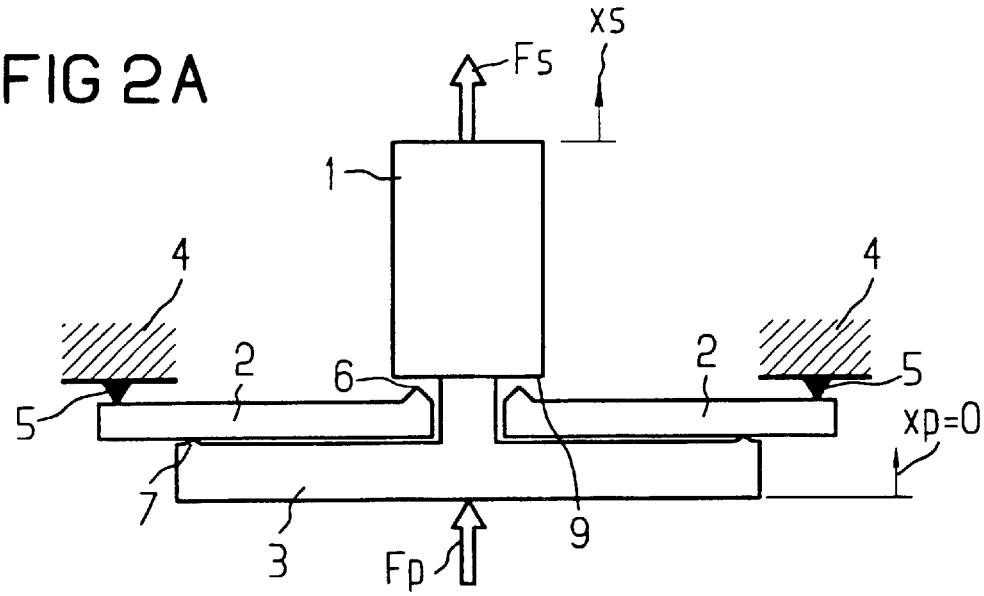
FIGS. 2*a* to 2*c* show a stroke transmitter in a number of stages of a stroke process.
Figure 2B:
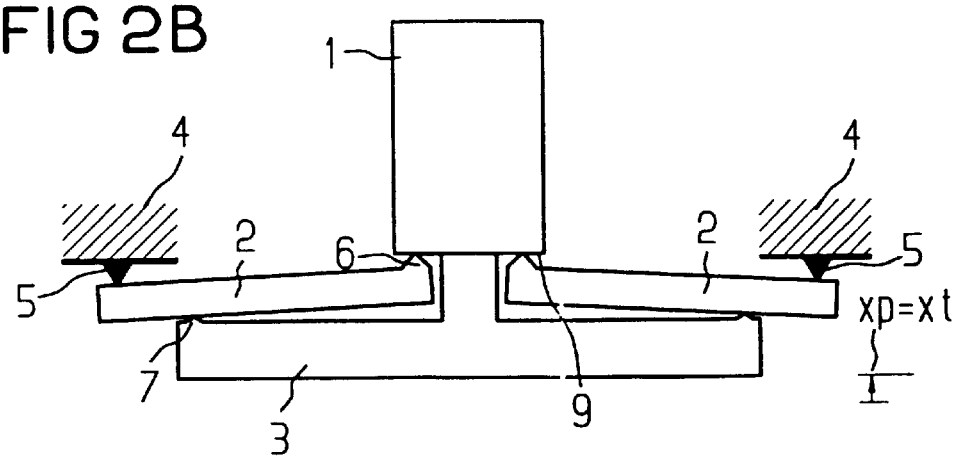
Figure 2C:
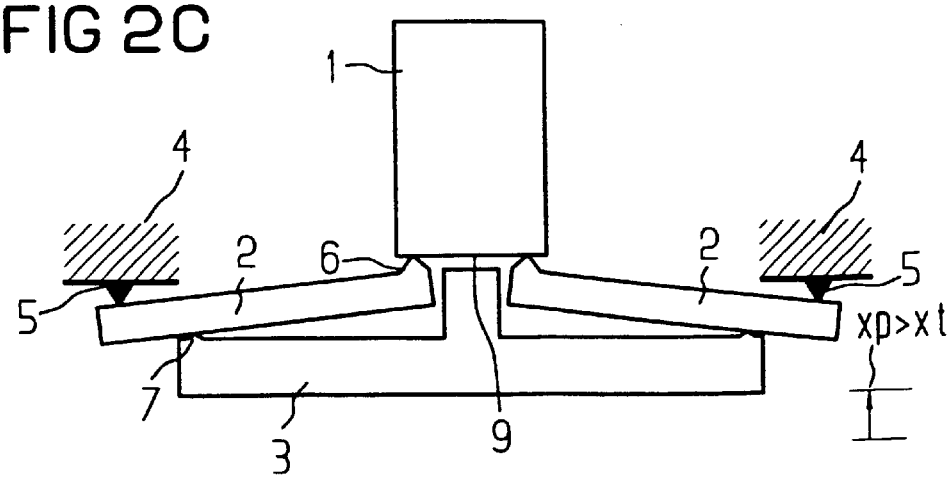

FIG. 2 schematically shows, as a sectional representation in a side view, a stroke transmitter according to FIG. 1, in the initial position (FIG. 2*a*), at the changeover point or the time of the placing of the lever 2 on the stroke element 1 (FIG. 2*b*), and after the initiation of the lever effect (FIG. 2*c*).

FIG. 2*a* shows the image (analogous to FIG. 1), of the stroke transmitter in the initial position.

FIG. 2*b* shows the stroke transmitter when the primary stroke xp reaches the changeover point xt=h·(L1/L2), in which the levers 2 come to rest on the stroke point 6 on the seating surface 9 of the stroke element 1.

The motion between the states in FIG. 2*a* and FIG. 2*b*, given an increasing primary stroke xp, is distinguished in that II=1, due to the direct non-positive connection or abutment between the drive element 3 and the stroke element 1. Due to the displacement of drive element 3 and stroke element 1 relative to the bearing 4, as stroke xp or, respectively, xs increases, the spacing h between stroke point 6 and stroke element 1 decreases constantly.

Any suitable types of actuators or actuating drives may be used as drive means for the displacement of the drive element 3. For rapid switching, particularly given use in a servo-controlled fuel injector, a piezoactuator is well-suited as a drive means.

FIG. 2*c* shows the stroke transmitter beyond the changeover point given a primary stroke xp>xt.

After placement of the lever 2 on the stroke element 1, a lever effect is present, so that now a stroke ratio II=L2/L1, where the stroke factor II>1, and producing a stroke gearing up effect or ratio increase. Given a stroke gearing up, the stroke element 1 lifts off the drive element 3, and is displaced due to the lever effect alone.

In order to avoid an undesired displacement of the stroke element 1 given a thermally caused change in length of the drive element 3, in the initial position a separate spacing between drive element 3 and stroke element 1 can be provided, in addition to the spacing h. This will eliminate the non-positive connection or abutment between the drive element 3 and the stroke element 1 in the initial position.

In this way it is possible to trigger a secondary stroke xs that is dependent exclusively on the stroke xp of the drive element 3. In contrast to a hydraulic or mechanical-hydraulic stroke transmission, this purely mechanical stroke transmission is fluid-independent. This yields for example the advantage that the secondary stroke xs is largely independent of the duration of actuation.

Figure 3A:
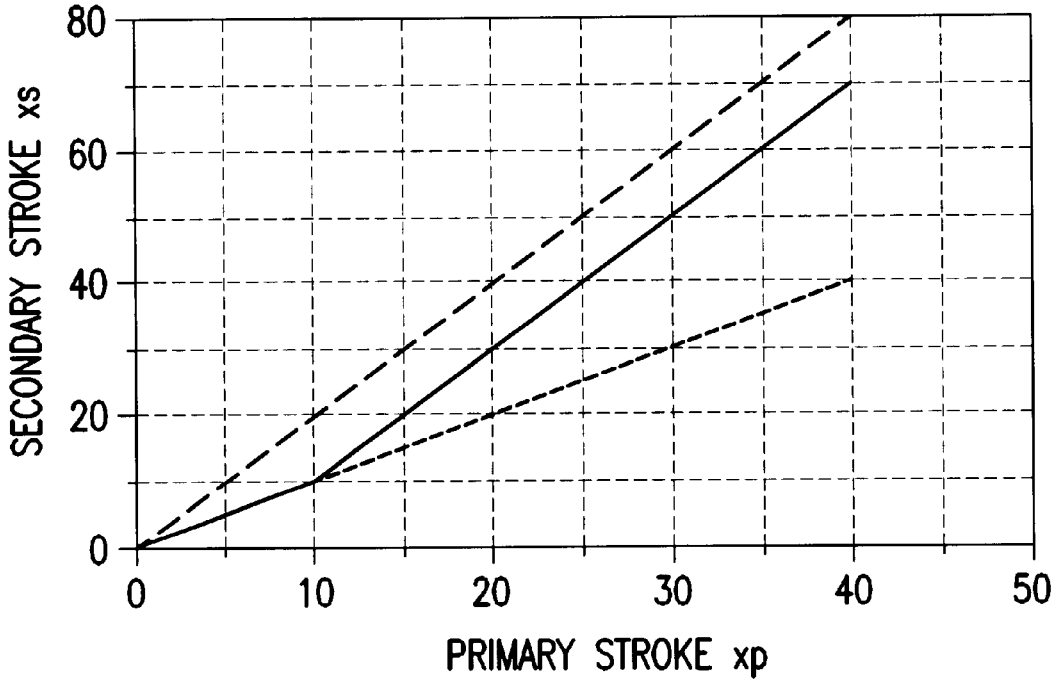
FIGS. 3*a* to 3*c* show the dependence of various variable of the stroke transmitter on one another.
Figure 3B:
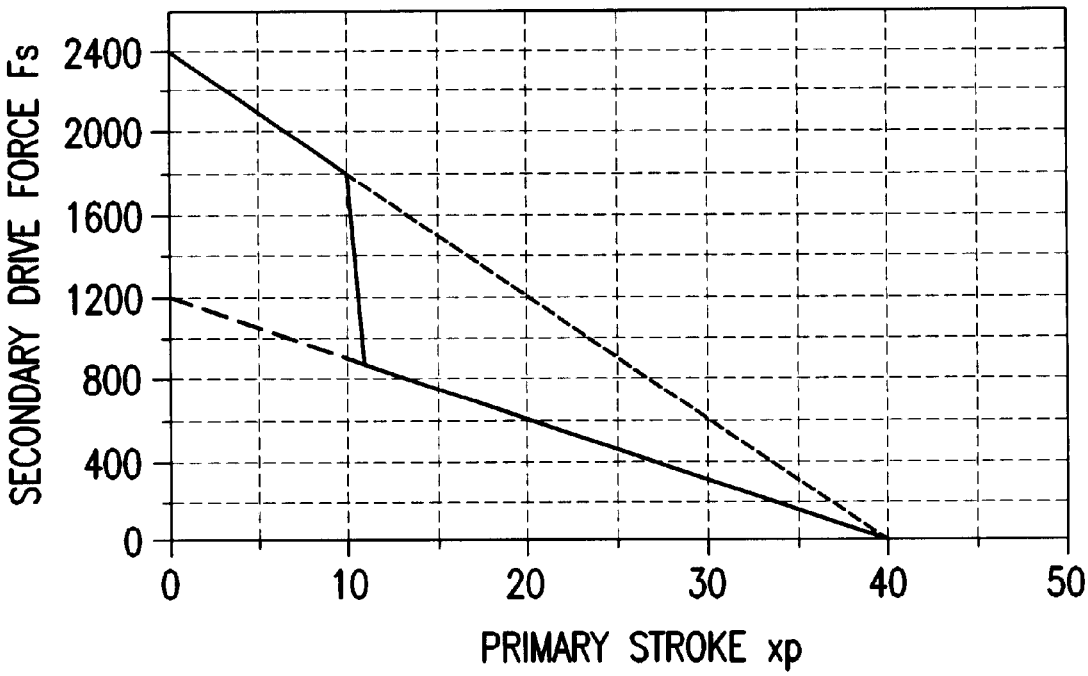
Figure 3C:
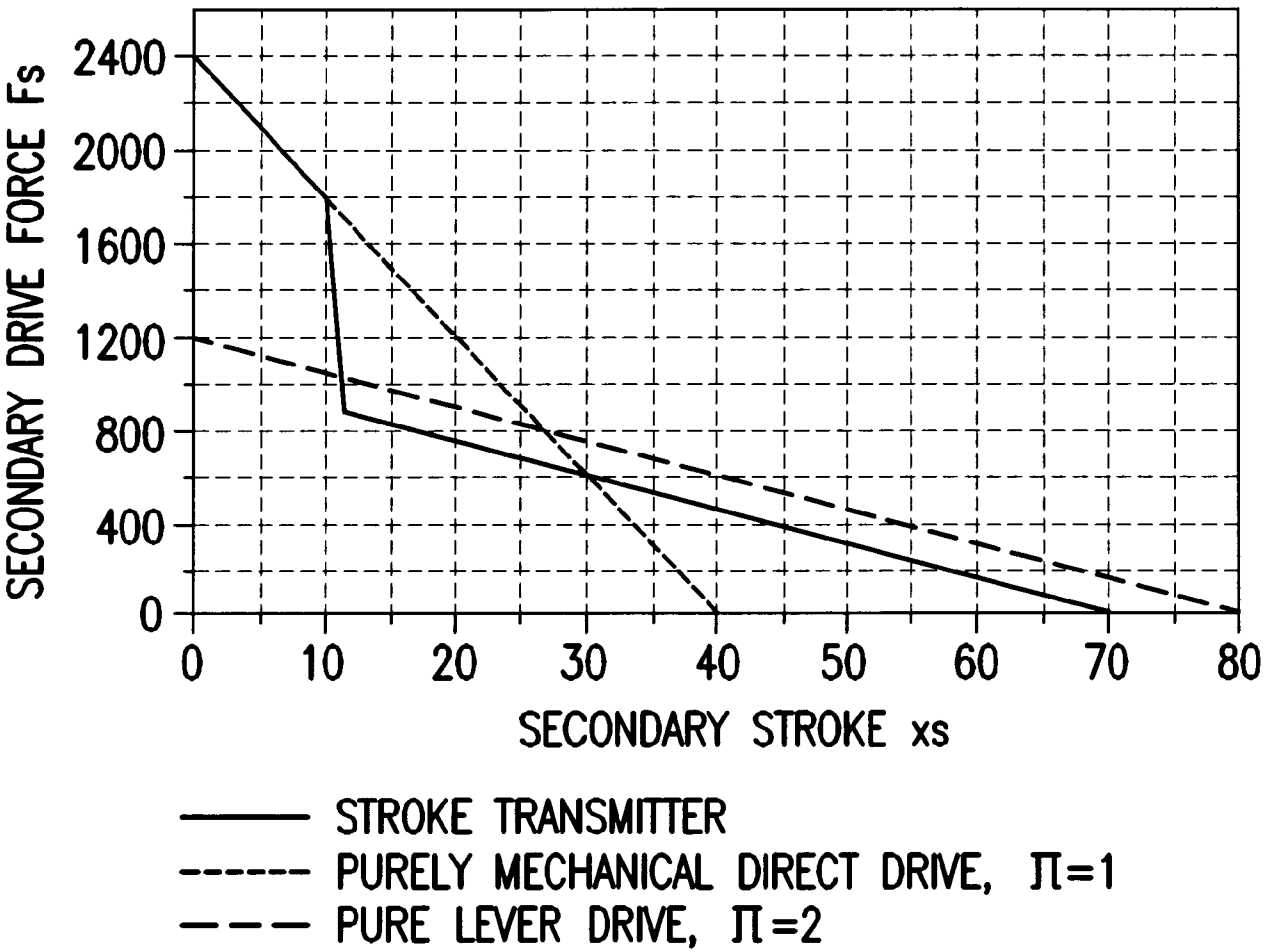

FIG. 3 shows, for a drive element 3 driven by means of a piezoelectric actuator, a plotting of the secondary stroke xs against the primary stroke xp (FIG. 3*a*), a plotting of the secondary drive force Fs of the stroke element 1 against the primary stroke xp (FIG. 3*b*), and plotting of the secondary drive force Fs against the secondary stroke xs (FIG. 3*c*), respectively for a pure lever drive having stroke factor II=2 (coarsely hatched), a purely mechanical direct drive (finely hatched) having stroke factor II=1, and a stroke transmitter according to FIGS. 1 and 2 having stroke factor II=1 and II=2 (solid line).

In FIG. 3*a* it is documented that initially the stroke transmitter transmits with the same stroke factor II=1 as the direct drive, and changes over to the stroke factor II=2 of the lever drive after reaching the changeover point xt=10 (in arbitrary units).

FIG. 3*b* shows that until the changeover point xt is reached, the values of the stroke transmitter correspond to those of the direct drive, and after reaching the changeover point xt they drop rapidly to the values of the pure lever drive.

In FIG. 3*c* it is shown that after reaching the changeover point xt, the secondary drive force Fs of the stroke transmitter falls below the value for the lever drive, whereby the difference due to the original spacing h between lever 2 and stroke element 1 is achieved at the stroke transmitter.

It can thus be seen clearly from FIGS. 3*a* to 3*c* that by means of the stroke transmitter a large force can be transmitted at the beginning of the actuation process, and after changeover to a purely lever-supported manner of operation, the path characteristic of a pure lever drive is exploited.

Figure 4:
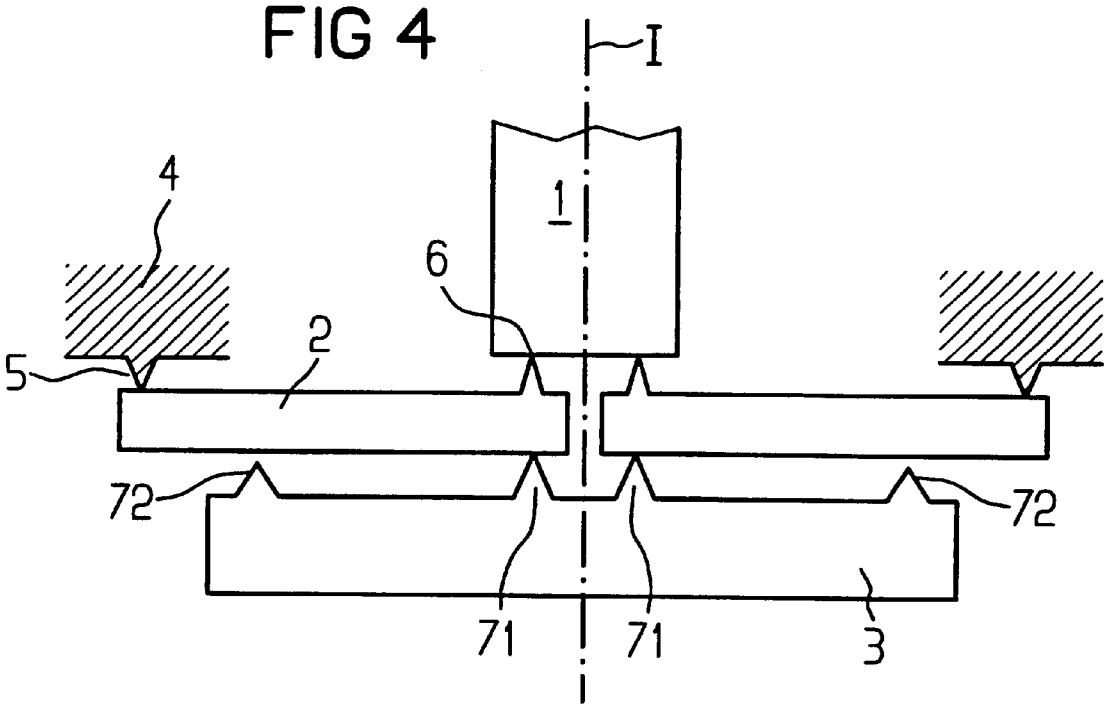
FIG. 4 shows another alternative embodiment of a stroke transmitter.

FIG. 4 shows, as a sectional representation in a side view, a further exemplary embodiment of a stroke transmitter in the initial position.

In the initial position, the at least two lever 2 are applied to an interior force introduction point 71 on the drive element 3. At the same time, the stroke element 1 is applied respectively to a stroke point 6 on the levers 2 and to a pivot point 5 on the bearing 4. In this way, through the levers 2 a mechanical non-positive connection or abutment is communicated between the drive element 3 and the stroke element 1.

The interior force introduction point 71 and the stroke point 6 of a lever 2 lie on a line parallel to the axis of rotation I. In this way, when the lever 2 is placed only on or in contact only with the interior force introduction point 71, the length L1 of the power arm corresponds to the overall effective lever length L1+L2, so that due to the missing lever effect a neutral stroke transmission II=1 results.

Given an actuation process, the drive element 3 is displaced along the axis of rotation I relative to the bearing 4. Because the length L1 of the power arm is equal to the effective length L1+L2 of the lever 2, no lever effect is produced by means of the lever 2; rather, the primary stroke xp is transmitted directly to the stroke element 1 with no loss of stroke. At the same time, by the motion of the stroke element 3 relative to the bearings 4, the levers 2 are rotated in the direction of the drive element 3, whereby the interior force introduction point 71 acts as a pivot point.

As soon as the primary stroke xp is large enough that the levers 2 are placed on or come in contact with another, external force introduction point 72, . . . , 7*n*, ($n \in N_+$) as the interior force introduction point 71 (i.e., a contact point changes), the length L1 of the power arm, which is now smaller than the length L1+L2 of the work arm, changes. Thus, in looking at FIG. 4, there can be n number of force introduction points spaced radially outward from the axis of rotation I beginning with each introduction point 71, moving outward to the introduction points 72, and then moving outward to a next n number of force introduction points therefrom.

Thus, through the levers 2 a stroke factor II=1+L2/L1 is given, so that as the primary stroke xp increases further the levers 2 lift off from the interior force introduction point 71.

In this exemplary embodiment, there exists exactly one additional force introduction point 72, which is further removed from the axis of rotation I than is the interior force introduction point 71. However, in another specific embodiment arbitrary n exterior force introduction points 71, 72, . . . , 7*n* can be used, whereby standardly n increases with the distance from the axis of rotation I.

Given further displacement of the drive element 3 after placement on an external force introduction point 72, . . . , 7(n−1), each lever 2 can successively be placed on additional exterior force introduction points 73, . . . , 7*n*, (though not shown) where each time the length of the power arm L1 is reduced discontinuously. By means of such an arrangement, n stroke ratios II can be set dependent on the primary stroke xp.

Figure 5:
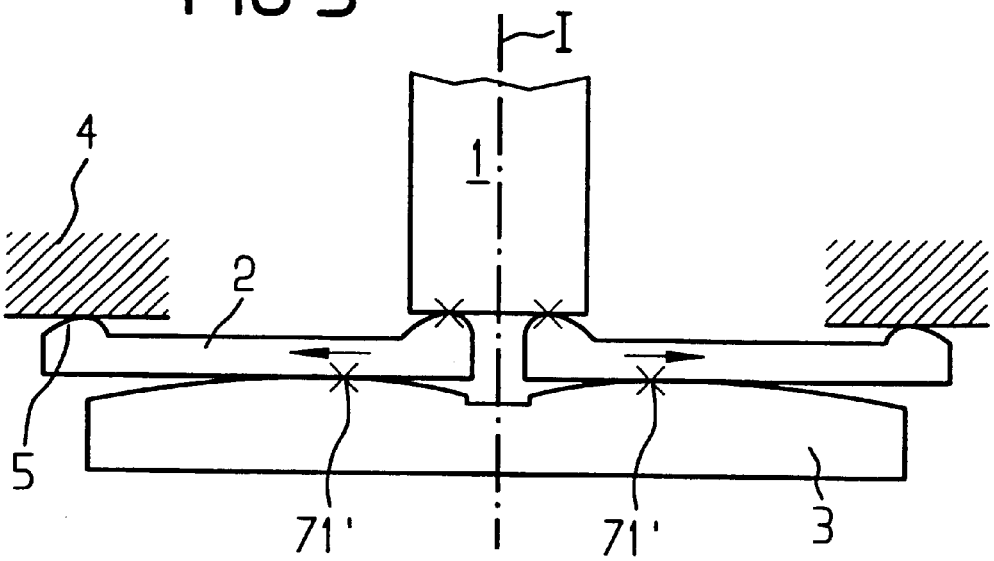
FIG. 5 shows still another alternative embodiment of a stroke transmitter.

In FIG. 5, in the initial position an additional exemplary embodiment is shown as a sectional representation, in a side view.

Here, in contrast to FIG. 4, no discrete force introduction points 71, . . . , 7*n* are present. In contrast, the levers 2 are placed on a curved surface of the drive element 3, which corresponds to a non-finite number of force introduction points whereby the n number of force introduction points approaches infinity or $n \rightarrow \infty$.

In this way, it is achieved that, given a displacement of the drive element 3, a continuous modification of the length L1 of the power arm is possible.

The surface can thereby also be curved in such a way that given a displacement of the drive element 3, a neutral stroke transmission takes place.

The surface can also be shaped such that the stroke factor II changes continuously only from one section to the next over various regions where one of the abutment surfaces of one of the elements has a sinusoidal curve. For example, in the direction of the stroke element 1, the surface is fashioned concavely and convexly from one section or one region to the next.

For the improved variation of the stroke factor II, it is advantageous if the at least one lever 2 likewise has a curved surface that is applied to at least one contact point 5, 6, 7, 71, . . . , 7*n*, 71', . . . , 7*n*'.

Figure 6:
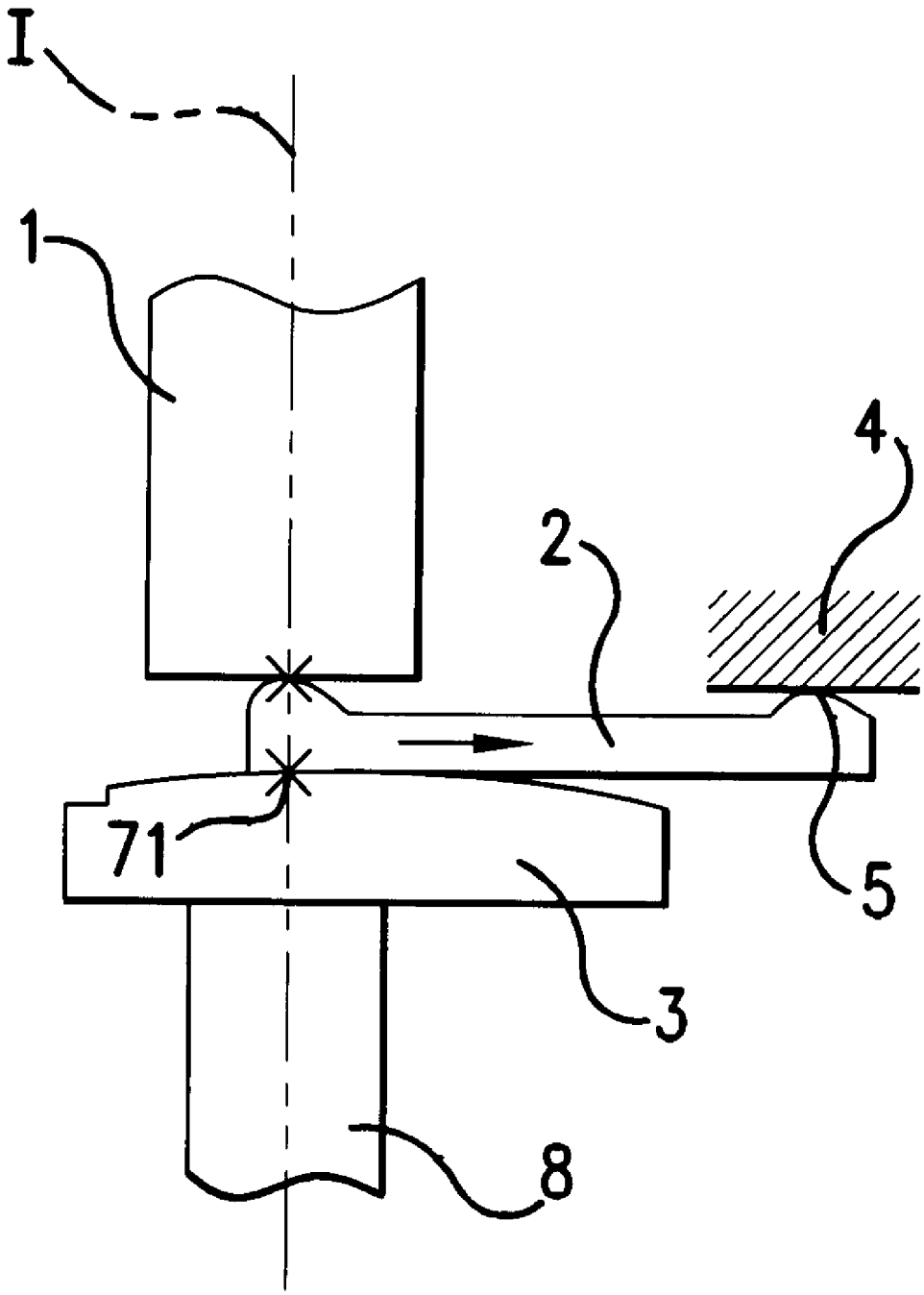
FIG. 6 shows yet another alternative embodiment having a single lever arm and a ceramic multilayer piezoactuator as a drive element.

It is additionally advantageous if exactly one lever 2 (see FIG. 6) is used, because then an adjustment of several levers 2 in order to ensure an equal lever effect is omitted. A possible decentering of the stroke element 1 can largely be compensated by means of a guiding of the stroke element 1, e.g. in a bored hole.

As a lever bearing, all constructions known from lever technology are suitable, e.g. knife-edge bearings or roller bearings and flexible bearings, as well as combinations of these. An initial direct non-positive connection or abutment between drive element 3 and stroke element 1 can also take place via cams that pass by the levers 2 laterally.

What is claimed is:

1. A stroke transmission apparatus comprising:

at least one bearing displaced radially from an axis;

a displaceable drive element movable relative to the bearing along the axis;

a displaceable stroke element being displaced in the same direction relative to the axis as the drive element;

at least one lever being engageable by the drive element, and being engageable on the stroke element and on a pivot point of the bearing in an initial position with the stroke element and the drive element sitting loosely on one another with a spacing between the at least one lever and the stroke element, so that during an enlargeable primary stroke, the spacing is reduced to form a seating of the at least one lever on the stroke element with a simultaneous engagement of the at least one lever on the bearing and a primary stroke of the drive element can be transmitted to the stroke element via a lever effect of the at least one lever; and as the primary stroke progresses, a stroke factor is modified by modifying at least one contact point of the at least one lever.

2. A stroke transmission apparatus comprising:

at least one bearing displaced radially from an axis;

a displaceable drive element movable relative to the bearing along the axis;

a displaceable stroke element being displaced in the same direction relative to the axis as the drive element;

at least one lever being engageable by the drive element, and being seated on the stroke element and on the bearing, so that there is a mechanical non-positive connection between drive element and stroke element, via the at least one lever, during an initial position, the at least one lever being seated on an interior force introduction point of the drive element, a primary stroke of the drive element can be transmitted to the stroke element via a lever effect of the at least one lever and with a changing stroke of the drive element, the at least one lever is moved so that it engages an external force introduction point, to modify a stroke factor at least from region to region.

3. The stroke transmission apparatus according to claim 2, wherein the external force introduction points are spatially separated from one another.

4. The stroke transmission apparatus according to claim 2, wherein the external force introduction points pass over spatially into one another in a continuous fashion, at least from one region to the next.

5. The stroke transmission apparatus according to claim 4, wherein the at least one lever is seated on a surface of the drive element that is curved at least from one region to the next, so that by means of the primary stroke of the drive element a continuous modification of the stroke factor can be set at least from one region to the next.

6. The stroke transmission apparatus according to claim 1, wherein exactly one lever is present.

7. The stroke transmission apparatus according to claim 1, wherein by means of the drive element, a primary stroke from about 10 $\mu$m to 100 $\mu$m can be executed.

8. The stroke transmission apparatus according to claim 1, wherein the stroke factor is in a range of between about 1 and 10.

9. The stroke transmission apparatus according to claim 1, wherein the drive element can be displaced using a ceramic multilayer piezoactuator.

10. A stroke transmission apparatus comprising:

at least one bearing displaced radially from an axis;

a displaceable drive element movable relative to the bearing along the axis;

a displaceable stroke element being displaced in the same direction relative to the axis as the drive element;

at least one lever being engageable by the drive element, and being seated on a stroke point on the stroke element and engageable on the bearing in an initial position with the stroke element and the drive element sitting loosely on one another and a spacing between the at least one lever and the bearing, so that, during an enlargeable primary stroke, the spacing is reduced to form a seating of the at least one lever on the bearing, a primary stroke of the drive element can be transmitted to the stroke element via a lever effect of the at least one lever; and as the primary stroke progresses, a stroke factor is modified by modifying at least one contact point of the at least one lever.

11. The stroke transmission apparatus according to claim 10, wherein exactly one lever is present.

12. The stroke transmission apparatus according to claim 10, wherein by means of the drive element, a primary stroke from about 10 $\mu$m to 100 $\mu$m can be executed.

13. The stroke transmission apparatus according to claim 10, wherein the stroke factor is in a range of between about 1 and 10.

14. The stroke transmission apparatus according to claim 10, wherein the drive element can be displaced using a ceramic multilayer piezoactuator.

15. The stroke transmission apparatus according to claim 2, wherein exactly one lever is present.

16. The stroke transmission apparatus according to claim 2, wherein by means of the drive element, a primary stroke from about 10 $\mu$m to 100 $\mu$m can be executed.

17. The stroke transmission apparatus according to claim 2, wherein the stroke factor is in a range of between about 1 and 10.

18. The stroke transmission apparatus according to claim 2, wherein the element can be displaced using a ceramic multilayer piezoactuator.

* * * * *